US006898999B1

(12) United States Patent
Hsien

(10) Patent No.: US 6,898,999 B1
(45) Date of Patent: May 31, 2005

(54) SLEEVE WITH NON-ROUND CONNECTING PORTION

(76) Inventor: Chin-Ching Hsien, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/779,499

(22) Filed: Feb. 17, 2004

(51) Int. Cl.[7] ..... B25B 13/00

(52) U.S. Cl. ..... 81/124.6; 81/124.2; 81/124.3

(58) Field of Search ..... 81/124.6, 124.2, 81/124.3, 124.5, 124.7, 177.85, 121.1

(56) References Cited

U.S. PATENT DOCUMENTS 1,643,901 A * 9/1927 Peterson ..... 81/124.6

* cited by examiner

*Primary Examiner*—Joseph J. Hail, III
*Assistant Examiner*—Alvin J Grant

(57) ABSTRACT

A sleeve with a non-round engaging portion comprises a sleeve body having a receiving portion at one end thereof and a connecting portion at another end thereof; the connecting portion being communicated to the receiving portion; the connecting portion having four sides; each two opposite sides are symmetrical. The connecting portion has different sections which are different diameters for matching sizes of different spanners.

1 Claim, 3 Drawing Sheets

SLEEVE WITH NON-ROUND CONNECTING PORTION

FIELD OF THE INVENTION

The present invention relates to sleeves of spanners, and particularly to a sleeve with a non-round connecting portion, which is suitable for spanners of various sizes.

BACKGROUND OF THE INVENTION

Currently, sleeve spanners are used with matched sleeves for locking or releasing screwing elements of various sizes. Thereby, use of the sleeve spanners are convenient in many applications.

However, the size of the spanner is fixed for one corresponding sleeve. Thereby, for a predetermined sleeve, if no corresponding spanner, the sleeve cannot be used. Thereby, in this situation, the peripheral elements around the narrow workplace must be detached. Thereby, the labor of the workers is increased and the working time is prolonged results in increased cost.

Referring to FIG. 1, a prior art disclosed in U.S. Pat. No. 6,098,502, in the prior art, a variety of sleeves are disclosed. In FIGS. 1 and 2, the periphery of the sleeve has a round shape and in FIGS. 3 to 6, the periphery of the sleeve has a hexagonal shape. In FIGS. 7 and 8, the sleeve has threes layers, the upper two layers have hexagonal shapes and the lower layer has a round shape. Thereby, the advantage of this prior art is that the sleeve can be matched with opened spanners, flower type spanners or sleeve spanners. Thereby, it is convenient. If the sleeve is used with opened spanner or flower type spanner, the total size is reduced so that it can be used in narrow spaces.

However, above mentioned prior art still has above described deficiency, i.e., the sleeves must be used with matched spanners. It is often that the workers take time to find the spanners. Furthermore, the sleeves shown in FIGS. 7 and 8 of the prior art have a larger volume so that it still have above mentioned problem.

SUMMARY OF THE INVENTION

Accordingly, the primary object of the present invention is to provide a sleeve with a non-round connecting portion which comprises a sleeve body having a receiving portion at one end thereof and a connecting portion at another end thereof; the connecting portion being communicated to the receiving portion; the connecting portion having four sides; each two opposite sides are symmetrical.

The sleeve body has different sections of different diameters for receiving opened spanners or flower type spanners of different diameters so as to move the spanner.

The present invention can avoid the deficiencies of prior art, while the functions of prior art sleeves are retained. Thereby, the structure of the present invention is simpler than the prior art structure. Advantages of the present invention are that the present invention can be matched with sleeve form spanners. Other than being used with sleeve spanner, if no other sleeve spanner is in hand, the present invention can be used with an opened spanner or a flower type spanner as a replacement object. Moreover, the present invention can be used with opened spanners or flower spanners of different sizes.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to so that those skilled in the art may understand the objects, features, and characteristics of the present invention, but not to be used to confine the scope and spirit of the present invention defined in the appended claims.

Figure 1:
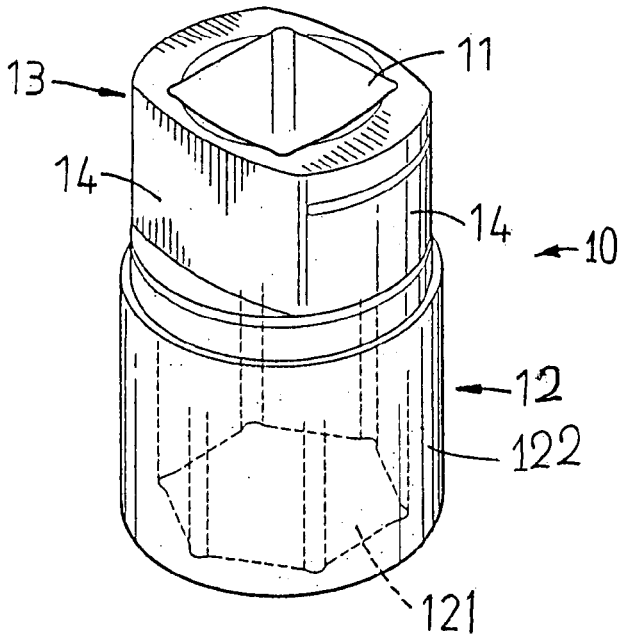
FIG. 1 is a perspective view the present invention.

Referring to FIG. 1, the structure of the present invention is illustrated. The structure of the present invention includes a sleeve body 10. An upper end of the sleeve body 10 has a connecting portion 11 which has a rectangular hole for receiving a rod therein. A lower end of the sleeve body 10 has a receiving portion 12 which has a hexagonal shape for receiving screwing element. In FIG. 1, it is illustrated that the connection portion 11 is a rectangular inner hole 11.

Furthermore, an outer edge of the upper end of the sleeve body 10 has a combining portion 13. The combining portion 13 is formed by two pairs of convex cambered surfaces 14 for receiving an opened spanner 20 or flower type spanner. Two convex cambered surfaces 14 of each pair are opposite arranged.

Figure 2:
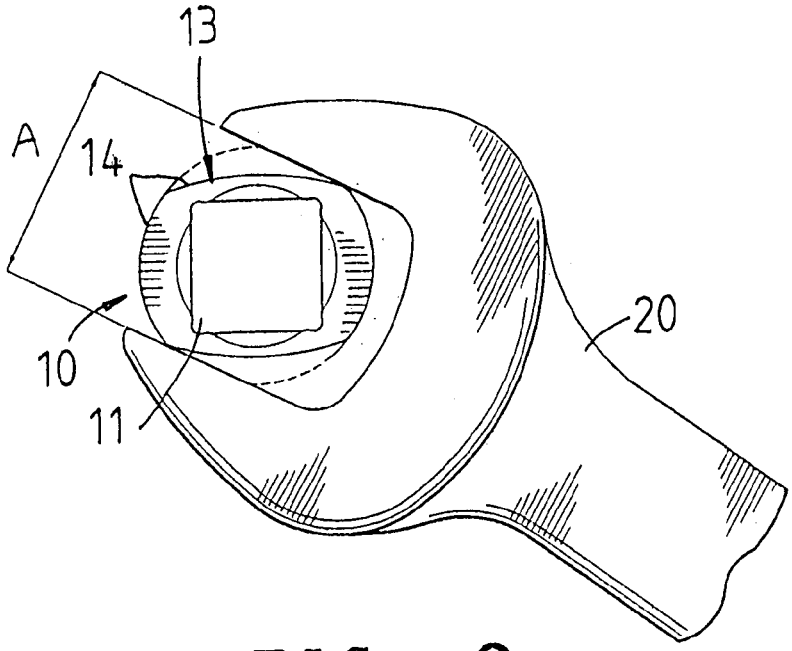
FIG. 2 is a schematic view of the present invention which is used to with a spanner.
Figure 3:
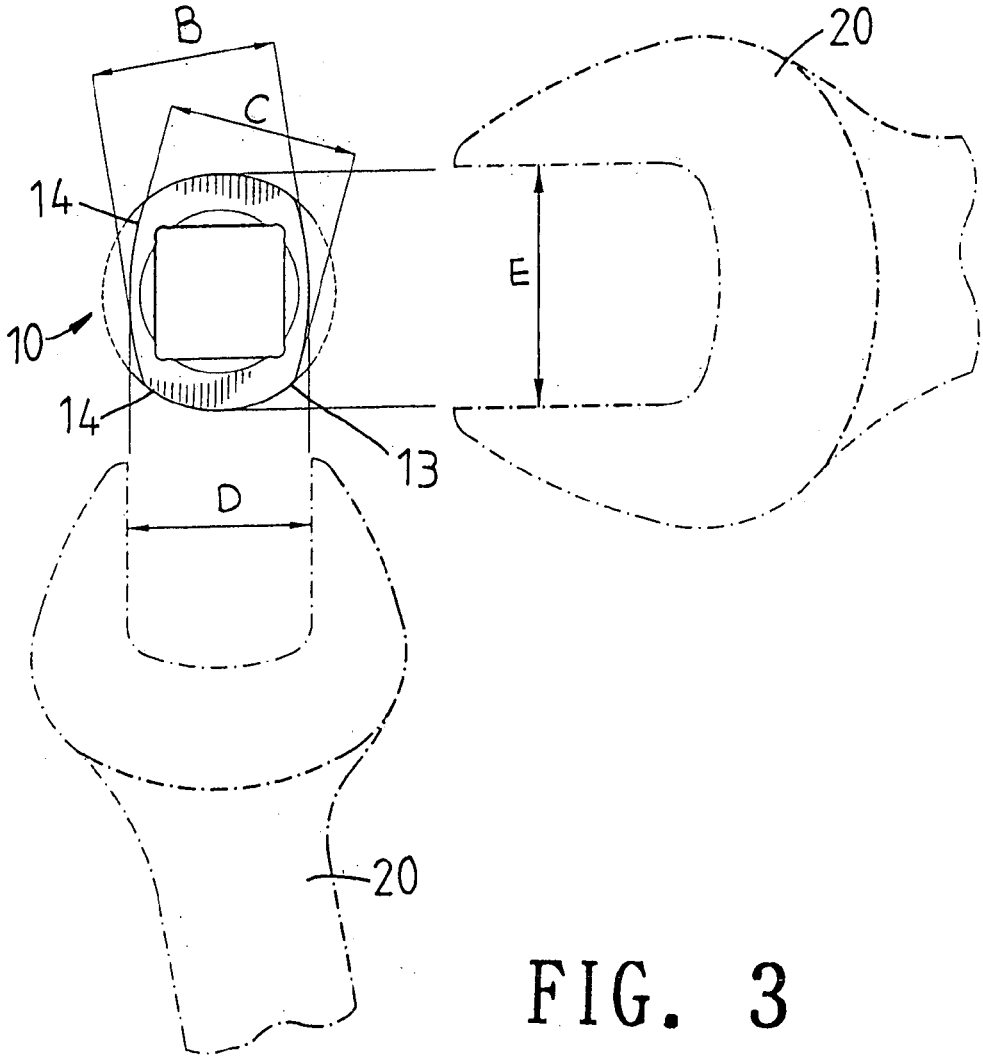
FIG. 3 is a schematic view showing the sleeve of the present invention is used with spanners of various sizes.

Referring to FIGS. 2 and 3, the convex cambered surfaces 14 are formed with different sections of different diameters for receiving opened spanners 20 or flower type spanners of different diameters. The sleeve body 10 has different sections of different diameters for receiving opened spanners 20 or flower type spanners of different diameters so as to move the spanner. For example, referring to FIGS. 2, 3, and 4, it is illustrated that spanners of different diameters A, B, C, D and E are buckled to the sleeve body 10 at positions of different diameters so that the spanners can be rotated.

Figure 4:
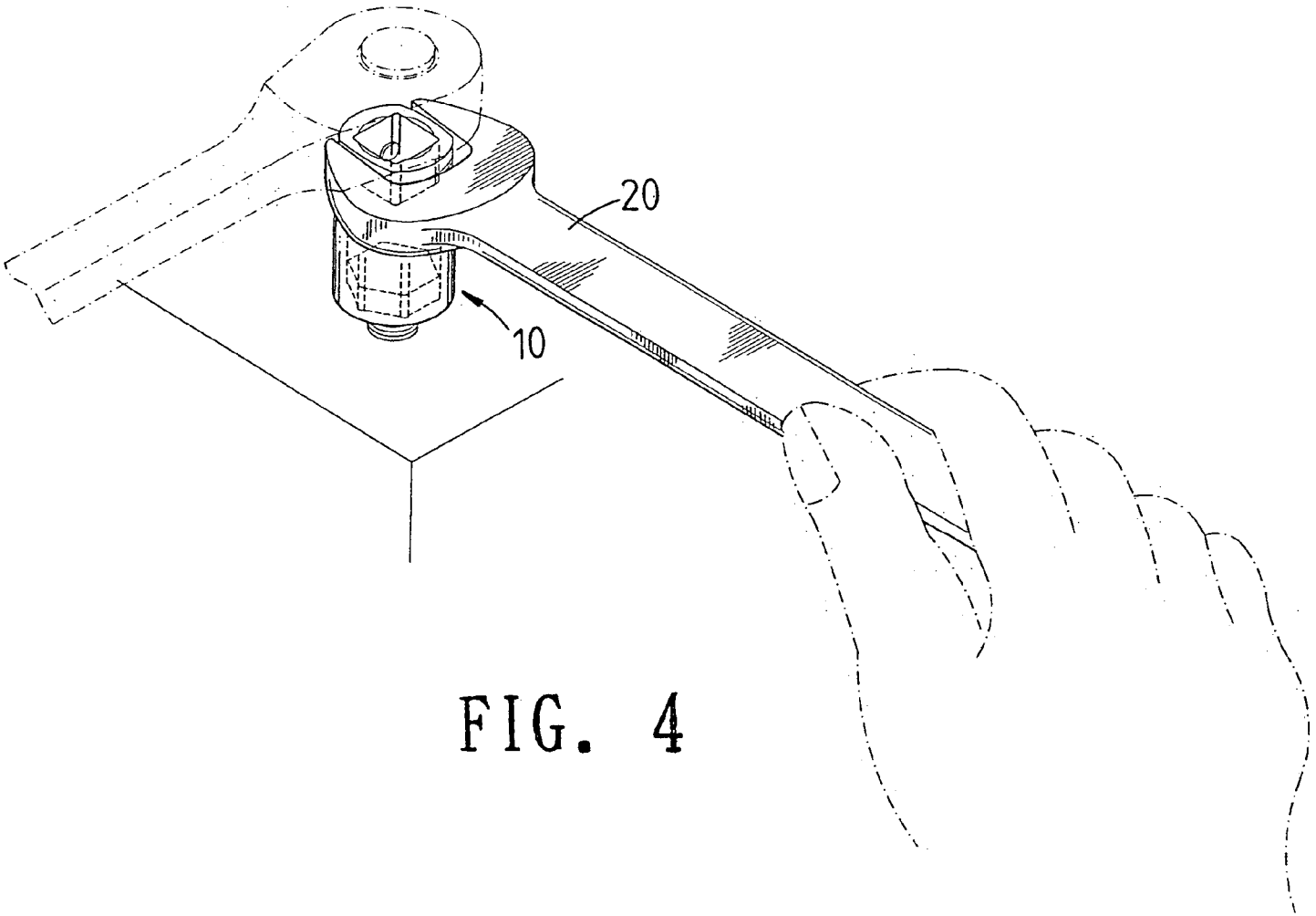
FIG. 4 is a reference of the present invention.

Referring to FIG. 4, a preferred embodiment about the application of the present invention is illustrated. It is only necessary that the size of the opened spanner 20 is between a maximum and a minimum size of the convex cambered surfaces 14. The opened spanner 20 will be engaged by the convex cambered surfaces 14 for screwing.

As above mentioned, it is known from the preferred embodiment that the present invention can overcome the deficiencies of prior art, while the functions of prior art sleeves are retained. Thereby, the structure of the present invention is simpler than the prior art structure. Advantages of the present invention is that the present invention can be matched with sleeve form spanner. Other than being used with sleeve spanner, if no other sleeve spanner is in hand, the present invention can be used with an opened spanner or a flower type spanner as a replacement object. Moreover, the present invention can be used with opened spanners or flower spanners of different sizes.

With reference to FIG. 1 of the present invention, it is illustrated that the sleeve body 10 has the receiving portion 12 at one end thereof and a portion 13 at another end thereof; and the receiving portion 12 has an hexagonal inner hole 121 and a round outer 122. The combining portion 13 has the rectangular inner hole 11 which is communicated to the hexagonal inner hole 121. The rectangular inner hole 11 has four inner wall; and the combing portion 13 has four outer walls. Two opposite walls of the four outer walls are symmetrical to a center of the rectangular inner hole 11 so as to match a size of a first spanner and the other two opposite walls of the four outer walls being symmetrical to the center of the rectangular inner hole 11 so as to match another size of a second spanner. Normal lines of the outer walls of the combining portion 13 are approximately vertical to a center axis of the rectangular hole inner hole 11.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A sleeve with a non-round connecting portion comprising:

a sleeve body having a receiving portion at one end thereof and a combining portion at another end thereof;

the receiving portion having an hexagonal inner hole and a round outer wall; and the combining portion having a rectangular inner hole which is communicated to the hexagonal inner hole of the receiving portion; the rectangular inner hole having four inner walls; and the combing portion having four outer walls; two opposite walls of the four outer walls being symmetrical to a center of the rectangular inner hole so as to match a size of a first spanner and the other two opposite walls of the four outer walls being symmetrical to the center of the rectangular inner hole so as to match another size of a second spanner; connecting portion having four sides; each two opposite sides are symmetrical; normal lines of the outer walls of the combining portion being approximately vertical to a center axis of the rectangular inner hole.

* * * * *